US012163403B1

(12) United States Patent
Zhong et al.

(10) Patent No.: US 12,163,403 B1
(45) Date of Patent: Dec. 10, 2024

(54) FLOW TUBE AND FLAPPER CONFIGURATION OF A SAFETY VALVE FOR A PRODUCTION WELLBORE

(71) Applicant: Halliburton Energy Services, Inc., Houston, TX (US)

(72) Inventors: Xiaoguang Allan Zhong, Singapore (SG); Mohan Gunasekaran, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/480,972

(22) Filed: Oct. 4, 2023

(51) Int. Cl.
*E21B 34/14* (2006.01)

(52) U.S. Cl.
CPC ..... *E21B 34/14* (2013.01); *E21B 2200/05* (2020.05)

(58) Field of Classification Search
CPC ..... E21B 2200/05; E21B 34/14
See application file for complete search history.

(56) References Cited

U.S. PATENT DOCUMENTS

| | | | | |
|---|---|---|---|---|
| 4,427,071 | A | 1/1984 | Carmody | |
| 4,597,446 | A | 7/1986 | Helderle | |
| 4,605,075 | A * | 8/1986 | Radford | E21B 25/02 175/246 |
| 4,890,674 | A | 1/1990 | Le | |
| 4,977,957 | A | 12/1990 | Pringle | |
| 5,137,090 | A | 8/1992 | Hare et al. | |
| 6,315,047 | B1 | 11/2001 | Deaton | |
| 7,363,980 | B2 * | 4/2008 | Pringle | E21B 34/08 166/332.8 |
| 7,708,066 | B2 * | 5/2010 | Frazier | E21B 34/14 166/334.1 |
| 7,762,336 | B2 * | 7/2010 | Johnson | E21B 34/10 251/303 |
| 8,261,836 | B2 * | 9/2012 | Noske | E21B 34/14 137/527 |
| 9,027,581 | B2 | 5/2015 | Butler | |
| 9,212,536 | B2 * | 12/2015 | Biddick | E21B 34/06 |
| 2002/0070028 | A1 * | 6/2002 | Garcia | E21B 34/14 166/373 |
| 2008/0271883 | A1 * | 11/2008 | Barton | E21B 34/063 166/317 |

(Continued)

OTHER PUBLICATIONS

"PCT Application No. PCT/US2023/076164, International Search Report and Written Opinion", Jun. 25, 2024, 10 pages.

*Primary Examiner* — Kipp C Wallace
(74) *Attorney, Agent, or Firm* — DeLizio, Peacock, Lewin & Guerra, LLP

(57) ABSTRACT

A safety valve for a wellbore for production of hydrocarbons from a surrounding subsurface formation includes a flow tube through which a flow of fluids from the surrounding subsurface formation downhole to a surface of the wellbore, wherein the flow tube comprises a lower end through which the flow of fluids is to enter the flow tube, wherein the flow tube is composed of metal, except for at least a cut out section of the lower end that is composed a polymeric material. The safety valve includes a flapper configured close the safety valve by changing positions to cover an opening at the lower end of the flow tube such that an impact force of the closing on the flapper onto the flow tube is at least partially absorbed by the polymeric material.

20 Claims, 8 Drawing Sheets

(56) References Cited

U.S. PATENT DOCUMENTS

| | | | | |
|---|---|---|---|---|
| 2009/0229829 | A1* | 9/2009 | Lloyd | E21B 34/102<br>166/330 |
| 2015/0204163 | A1* | 7/2015 | Hill | E21B 34/14<br>166/381 |
| 2023/0296000 | A1* | 9/2023 | Bucciarelli | E21B 33/04<br>166/332.8 |
| 2024/0026751 | A1* | 1/2024 | Helms | E21B 34/14 |

* cited by examiner

FLOW TUBE AND FLAPPER CONFIGURATION OF A SAFETY VALVE FOR A PRODUCTION WELLBORE

BACKGROUND

As part of hydrocarbon recovery operations, formation fluids including oil and gas produced at a wellhead may be conveyed through flow lines to remote gathering stations. For hydrocarbon recovery operations, subsurface safety valves which are responsive to certain changes in operating conditions may be used to shut off flow at the surface and/o below the surface of the wellbore at the onset of unusual or unscheduled operating conditions. For example, hydrocarbon recovery systems may include surface and subsurface safety valves which may be designed to automatically close in the event of fluctuations either above or below predetermined settings, such as high and low liquid levels, high and low temperatures, electrical power loss, etc. Also, catastrophic failures may occur in which the flow lines and wellhead equipment are destroyed by explosion, fire and the like. Offshore production wells must sometimes be shut off quickly to avoid storm damage. In such situations, it is imperative that well flow be terminated to avoid waste and pollution.

BRIEF DESCRIPTION OF THE DRAWINGS

Embodiments of the disclosure may be better understood by referencing the accompanying drawings.

DESCRIPTION

Figure 1:
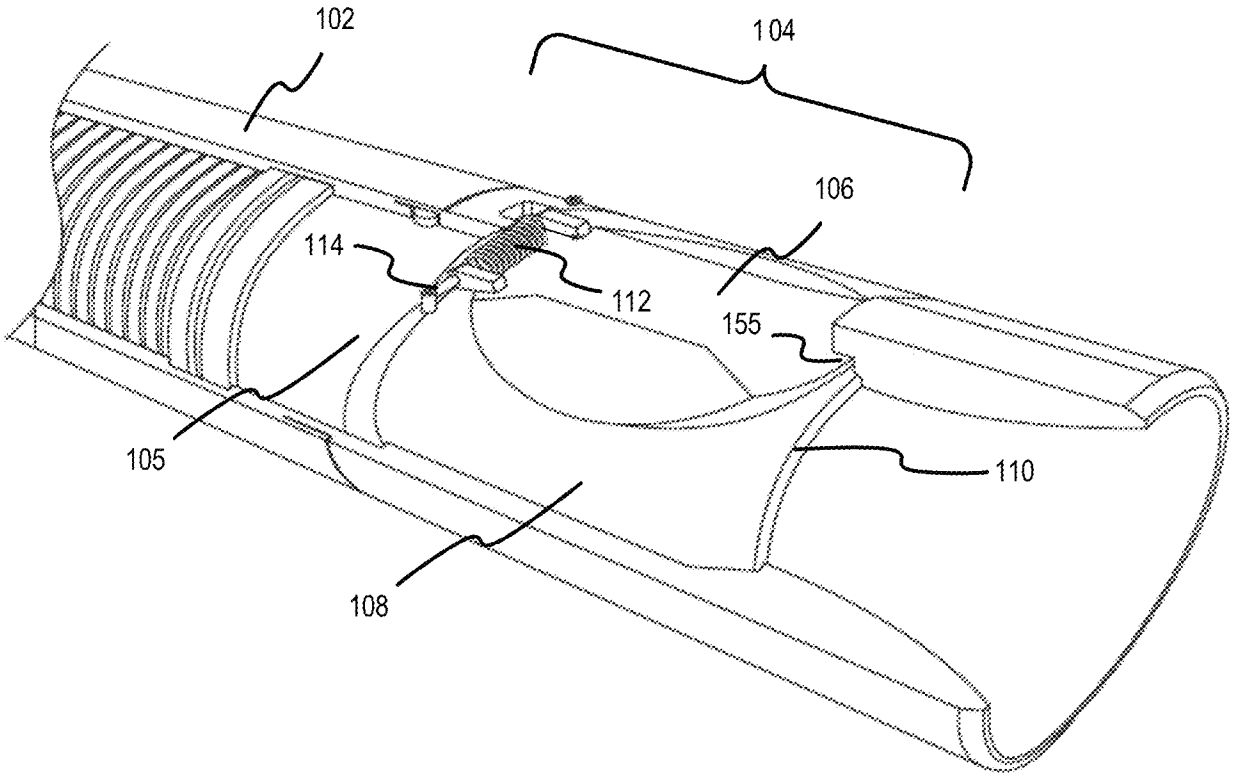
FIG. 1 is a perspective view of a subsurface safety valve in a casing within a wellbore, according to some embodiments.

The description that follows includes example systems, methods, techniques, and program flows that embody aspects of the disclosure. However, it is understood that this disclosure may be practiced without these specific details. In some instances, well-known instruction instances, protocols, structures, and techniques have not been shown in detail in order not to obfuscate the description.

During an emergency in a hydrocarbon recovery well, a safety valve may be required to suddenly close and seal off the production from the wellbore. That sudden closure may create a high impact force that may damage the safety valve components. Examples of such components may include a flow tube, a pin, a seat, the flapper itself, etc. For example, the pin used for holding the flapper in its movable position may be bent. Such a bent pent may prevent flapper closure and sealing. Additionally, the flow tube's hard-faced end could be fractured or severely deformed—making the inner diameter of the flow tube smaller than its drift inner diameter.

Example implementations may include a subsurface safety value that includes a flow tube having a lower end that may have a cut-out section that is adjacent to the flapper. The cut-out section may be replaced by polymeric materials (such as rubber, plastics, or other materials that can elastically deform to large strain). Such example implementations are in contrast to conventional approaches that include a design that has a high hardness Stellite coating to improve the abrasive resistance of the flow tube when it interacts with the flapper. However, this coating makes the material brittle and has limitations on resisting high impact loads.

In contrast, example implementations may include a flow tube that may be composed of a high ductile material (such as metal, steel, etc.) but includes a cut out section at the lower end that may be adjacent to the flapper interaction area. This cut out section may be replaced with polymeric materials that can withstand high impact force and can prevent abrasion. Accordingly, example implementations may include a robust and reliable safety valve that may withstand high-rate gas slam closure—while still providing the same function as existing valves.

Thus, in some implementations, a portion of the lower end of the flow tube may be replaced by an elastic material, such as rubber or other polymeric material. When the flapper slams into the flow tube, the elastic patch deforms elastically to absorb some impact energy while allowing the flow tube to move away. Thus, even if the flapper rotates extremely fast, the flapper may hit a much larger area of the metallic flow tube. However, the polymeric material in the cut out section at the lower end of the flow tube may substantially reduce the load and impact on the metallic flow tube and reduce or eliminate damage to parts of the safety valve. The use of this elastic material may be that this material may recover to its original shape. Thus, when flapper valve is reopened for production, the flow tube may seal off the pocket for the flapper, preventing sand deposition during production.

In some implementations, the lower end of the flow tube (not including the material that fills in the cut out section) may be coated with a nonmetallic coating. For example, the lower end (not including the material that fills in the cut out section) may be coated with a hard plastic.

Example Safety Valves

Different example implementations of a safety valve are now described with reference to FIGS. 1-3 and 4A-4F. FIG. 1 is a perspective view of a subsurface safety valve in a casing within a wellbore, according to some embodiments. FIG. 1 depicts a portion of a tubing 102 that is positioned within a wellbore. An example of an overall well system having a safety valve is depicted in FIG. 5 (which is further described below). The tubing 102 may be production tubing that may provide a fluid conduit for communicating fluids (e.g., hydrocarbons) extracted from the surrounding subterranean formations to the well surface.

A safety valve 104 is positioned downhole in the wellbore within the tubing 102. The safety valve 104 includes a flow tube 108, a flapper 106, a spring 112, and a pin 114. Control and balance lines (not shown) may be from a surface of the wellbore and along the tubing 102 to the safety valve 104. The control and balance lines may be communicatively coupled to the safety valve 104 for controlling the opening and closing of the safety valve (as further described below). The flapper 106 is coupled to an outer housing 105 with the spring 112 and the pin 114. For example, the pin 114 may be placed through the spring 112 and a hinge of the flapper 106.

The flow tube 108 may include a lower end 110 through which the flow of fluids is to enter the flow tube 108. For example, fluids from the surrounding formation may enter into the flow tube 108 to be delivered to the surface of the wellbore via the lower end 110. During operation, the flow rate through the flow tube 108 may be very high (such as several hundred feet per second). In an emergency, the closing of the safety valve 104 may need to be sudden. To close the safety valve 104, a control line may cause the flow tube 108 to move upward into the outer housing 105, thereby causing the flapper 106 to close over the lower end 110.

This sudden closure of the safety valve 104 may create a high impact force against the lower end 110. Such force may damage components (such as the flow tube 108, the pin 114, the flapper 106, and the spring 112) of the safety valve 104. For example, the inner diameter of the flow tube 108 may be reduced as a result of such force. This reduction may inhibit or prohibit other tools from passing through the flow tube 108.

Accordingly, in example implementations, the lower end 110 of the flow tube 108 may have a cut out section wherein a section has been removed or cut out and replaced with an elastically deformable material (such as rubber, plastics, etc.). In some implementations, the cut out section may be of different shapes and sizes (as further described below). For example, a shape of the cut out section may be a rectangle, partial elliptical circle, etc. For instance, a shape of the cut out section may be a rectangular such that the width is greater than the depth. In another example, the shape of the cut out section may be a partial ellipse. In some implementations, the cut out section may include the area of the lower end 110 of the flow tube 108 that the flapper 106 first comes into contact when the flapper 106 is closing.

Accordingly, in some implementations, to minimize damage that may be caused by this sudden closure of the safety valve 104, the flow tube 108 may be composed of a high strength, high ductile material (such as metal, steel, etc.), except for at least a cut out section of the lower end 110. For example, the flow tube 108 may be composed of iron, copper, aluminum, etc. This cut out section of the lower end 110 may be composed of a polymeric material or other elastomer-based material (such as rubber, plastics, or other materials that can elastically deform to large strain). In some implementations, this cut out section may be composed of any type of material that has the ability to deform under stress and return to their original shape after the stress is removed. In some implementations, the cut out section of the lower end 110 may be adjacent to the flapper 106 (as further described below). In some implementations, the inserted polymeric material may be bonded to the flow tube 108.

The flow tube 108 may be composed of high strength, high durable material (such as a metal) in order to have the strength to be able to force open the flapper in order to reopen the safety valve 104 (after being closed). This is due to the differential pressure between the downhole pressure and the uphole pressure relative to the safety valve 104. In some implementations, the flapper 106 and the lower end 110 of the flow tube 108 may be positioned in a side pocket 155 of the tubing 102. Accordingly, having this polymeric material in the cut out section of the lower end 110 of the flow tube 108 may preclude debris from getting into the side pocket 155.

In some implementations, the lower end 110 of the flow tube 108 (not including the material that fills in the cut out section) may be coated with a nonmetallic coating. For example, the lower end 110 (not including the material that fills in the cut out section) may be coated with a hard plastic.

Figure 2:
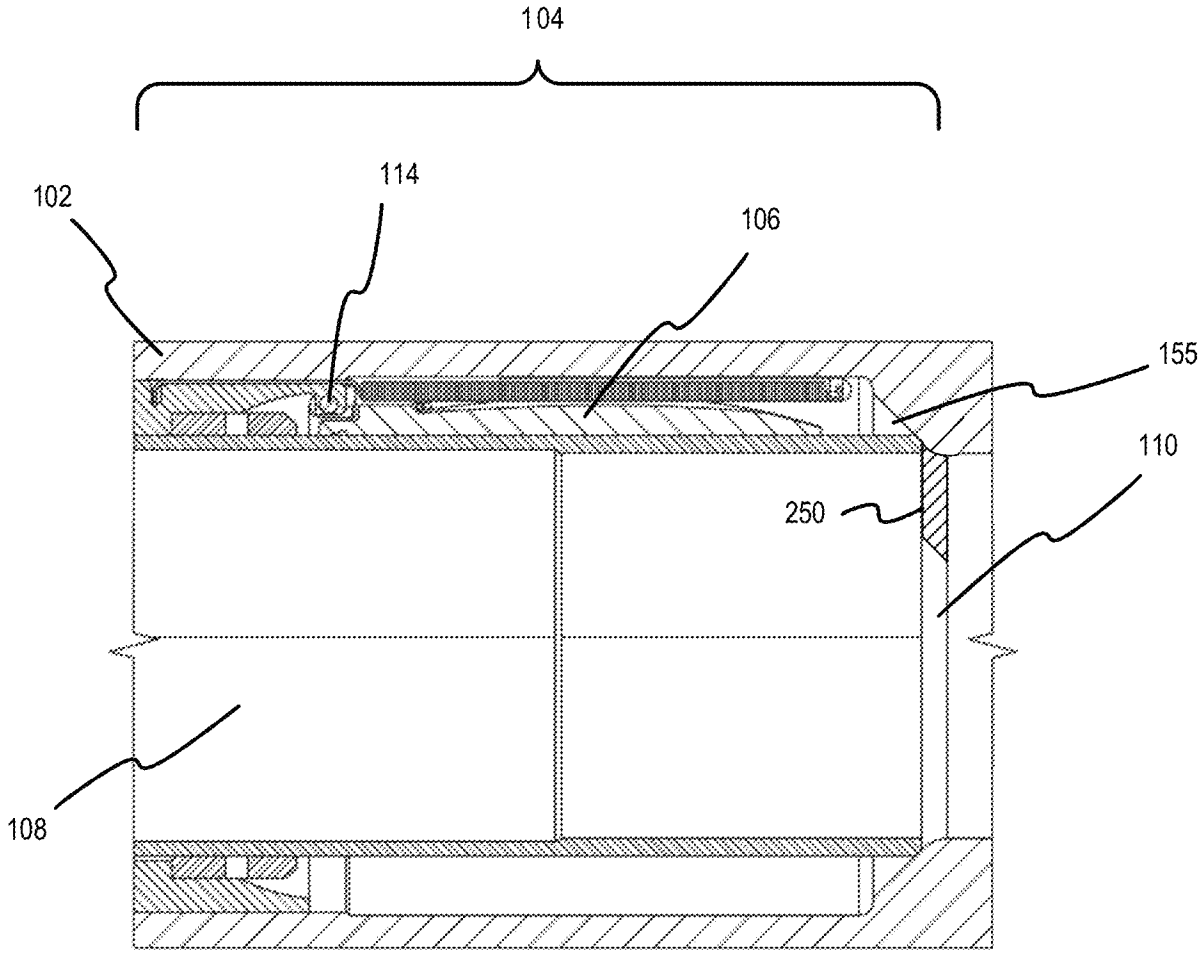
FIG. 2 is a cross-sectional side view of the subsurface safety valve of FIG. 1, according to some embodiments.

To further illustrate, FIG. 2 is a cross-sectional side view of the subsurface safety valve of FIG. 1, according to some embodiments. FIG. 2 depicts the tubing 102 that is positioned downhole in a wellbore with the safety valve 104 being positioned within the tubing 102. The safety valve 104 includes the flapper 106, the pin 114, and the flow tube 108 having the lower end 110. As shown, the lower end 110 includes a cut out section into which a polymeric material is placed. Also, the cut out section with the polymeric material may be positioned adjacent to the flapper 106 such that the flapper 106 may first contact the polymeric material of the lower end 110 when closing. Also as shown, the tubing 102 includes the side pocket 155 into which the flapper 106 and the polymeric material of the lower end 110 of the flow tube 108 may be positioned.

Figure 3:
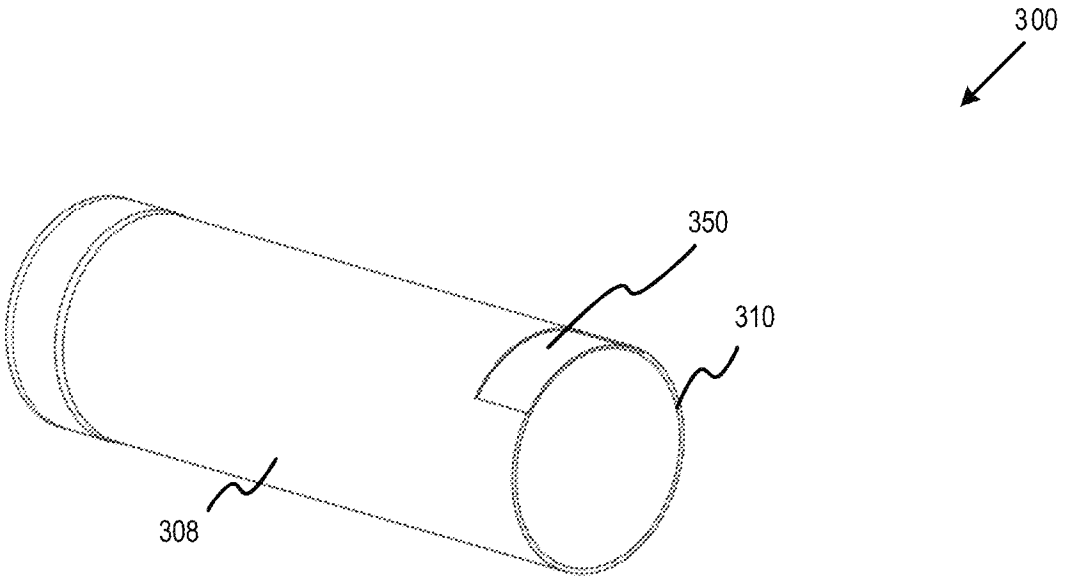
FIG. 3 is a perspective view of a first example flow tube of a subsurface safety valve and having a cut out end that includes a polymeric material, according to some embodiments.

FIG. 3 is a perspective view of a first example flow tube of a subsurface safety valve and having a cut out end that includes a polymeric material, according to some embodiments. FIG. 3 depicts a flow tube 308 that may be an example of the flow tube 108 of FIGS. 1-2. The flow tube 308 includes a lower end 310 that includes a cut out section that has been filled with a polymeric material 350. In this example, the shape of the cut out section is rectangular. In some implementations, the length of the rectangle along the lower end 310 is greater than a depth of the rectangle. For example, the length may be at least twice the depth.

Figure 4A:
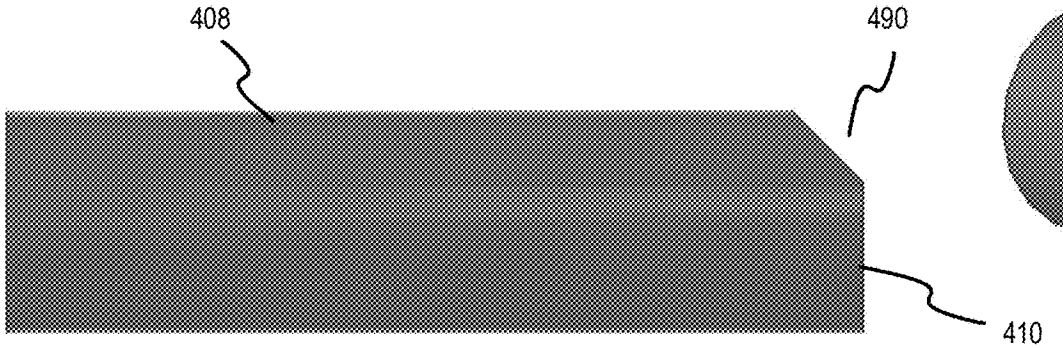
FIG. 4A is a side view of a second example flow tube of a subsurface safety valve with a portion of the end cut out, according to some embodiments.
Figure 4B:
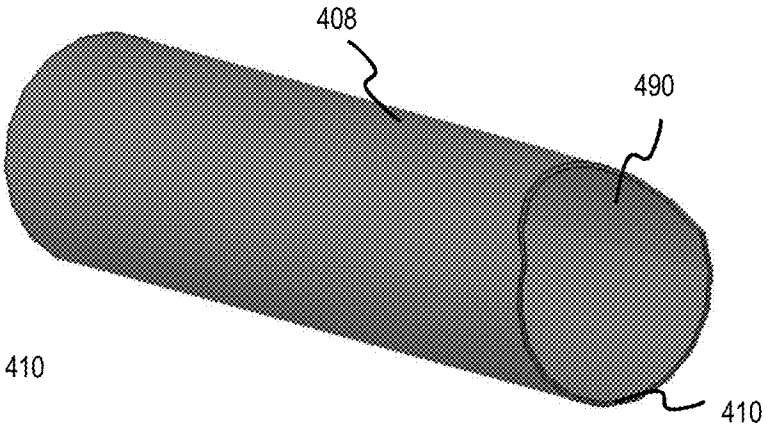
FIG. 4B is a perspective view of the second example flow tube of FIG. 4A, according to some embodiments.
Figure 4C:
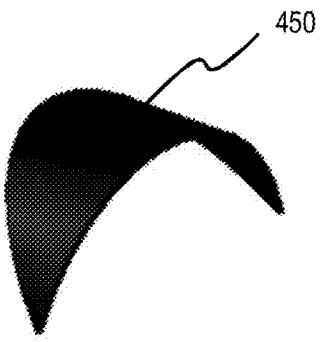
FIG. 4C is a perspective view of a polymeric material that is to be inserted into the end cut out of the second example flow tube of FIGS. 4A-4B, according to some embodiments.
Figure 4D:
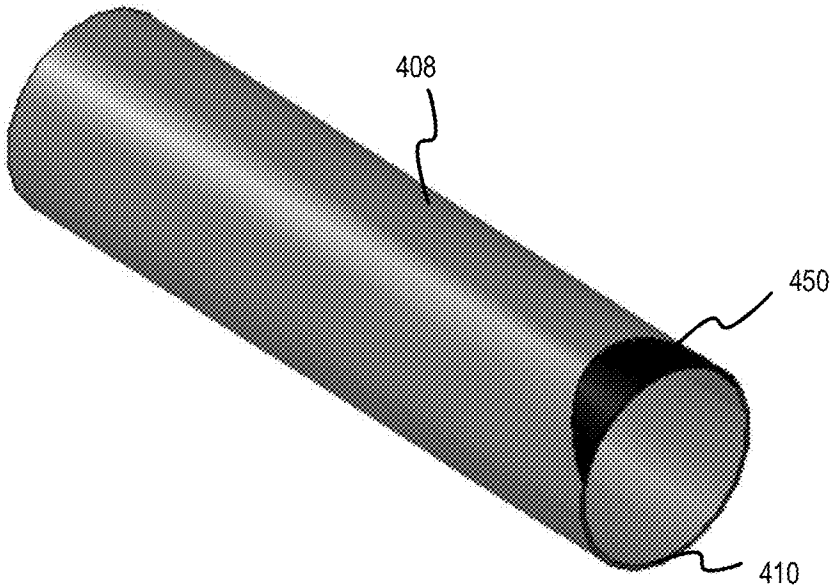
FIG. 4D is a perspective view of the second example flow tube of FIGS. 4A-4B with the polymeric material of FIG. 4C inserted into the end cut out, according to some embodiments.
Figure 5:
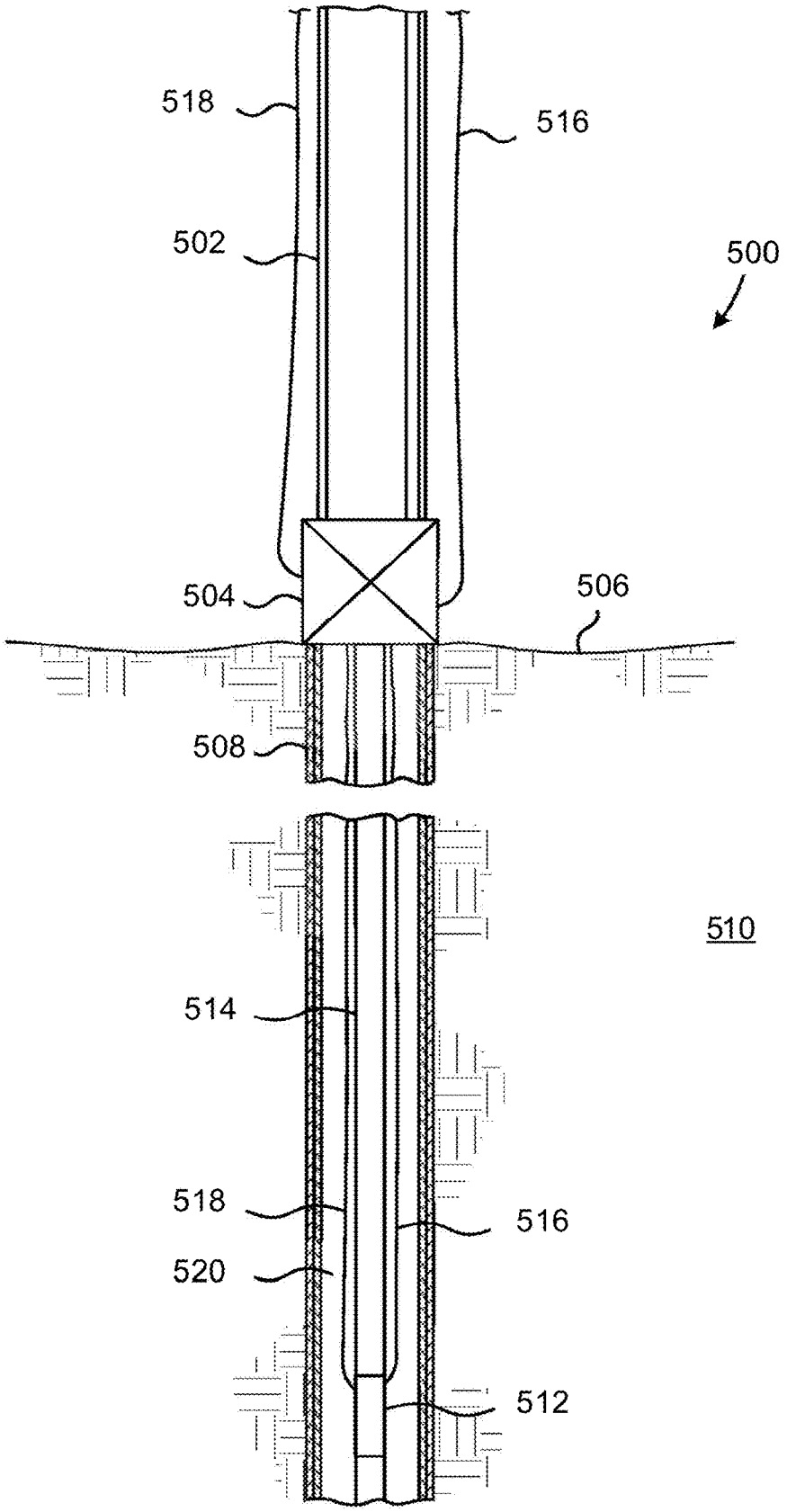
FIG. 5 is an elevation view in partial cross section of a well system having a subsurface safety valve, according to some embodiments.

FIG. 4A is a side view of a second example flow tube of a subsurface safety valve with a portion of the end cut out, according to some embodiments. FIG. 4B is a perspective view of the second example flow tube of FIG. 4A, according to some embodiments. FIG. 4C is a perspective view of a polymeric material that is to be inserted into the end cut out of the second example flow tube of FIGS. 4A-4B, according to some embodiments. FIG. 4D is a perspective view of the second example flow tube of FIGS. 4A-4B with the polymeric material of FIG. 4C inserted into the end cut out, according to some embodiments.

FIGS. 4A-4B and 4D depict a flow tube 408 having a lower end 410 that may be an example of the flow tube 108 and lower end 110 of FIGS. 1-2, respectively. FIGS. 4A-4B also depict a cut out section 490 being removed from the lower end 410. FIG. 54 depicts a polymeric material 452 that is to be positioned in the cut out section 490. FIG. 4D depicts the polymeric material 452 being positioned in the cut out section 490 of the lower end 410 of the flow tube 408.

Figure 4E:
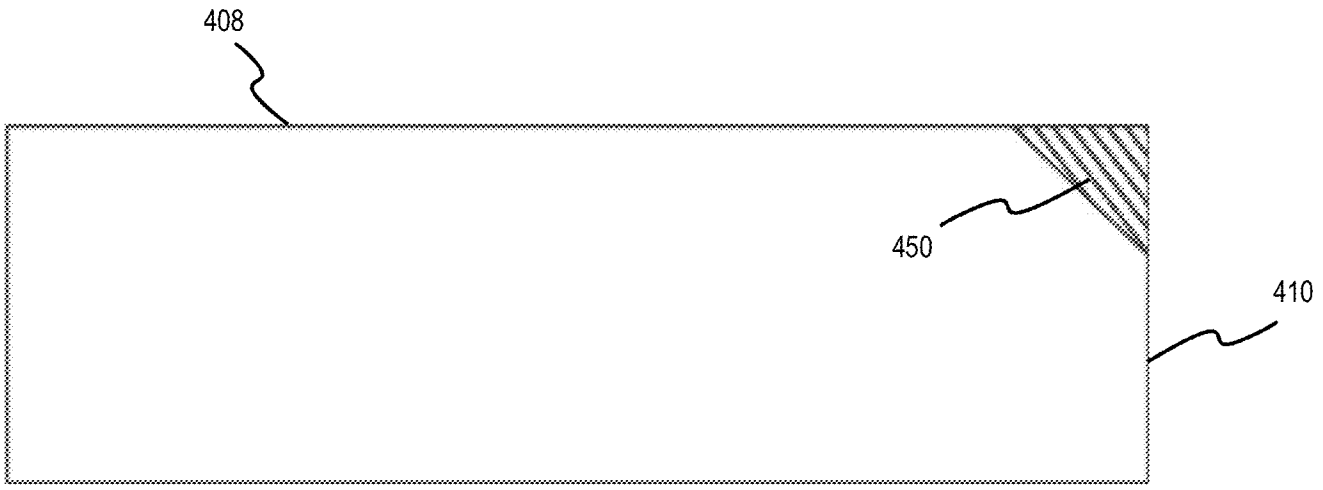
FIG. 4E is a side view of the second example flow tube of FIG. 4D of a subsurface safety valve and having a cut out end that includes a polymeric material, according to some embodiments.
Figure 4F:
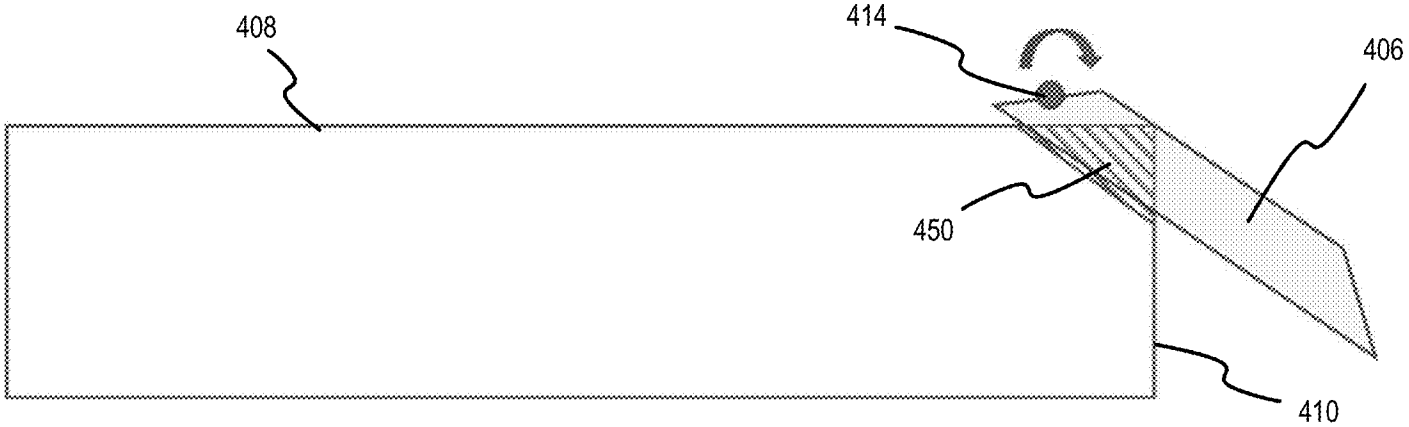
FIG. 4F is a side view of the second example flow tube of FIG. 4E that includes a flapper, according to some embodiments.

FIG. 4E is a side view of the second example flow tube of FIG. 4D of a subsurface safety valve and having a cut out end that includes a polymeric material, according to some embodiments. FIG. 4F is a side view of the second example flow tube of FIG. 4E that includes a flapper, according to some embodiments. The flow tube 408 includes a lower end 410 that includes a cut out section that has been filled with a polymeric material 450. FIG. 4F includes a flapper 406 with a pin 414 that may be examples of the flapper 106 and the pin 114 of FIGS. 1-2, respectively. FIG. 4F also depicts the movement of the flapper 406 to close the flow tube 408 to close the subsurface safety valve.

In this example, the shape of the cut out section and the polymeric material is a partial ellipse that includes a diameter that is along the lower end 410 and having a depth into the flow tube 408. The values of the diameter and the depth may vary. For example, in some implementations, the diameter is at least twice that of the depth.

Example System

FIG. 5 is an elevation view in partial cross section of a well system having a subsurface safety valve, according to some embodiments. As illustrated in FIG. 5, a well system 500 may include a riser 502 extending from a wellhead installation 504 positioned at a surface 506. The riser 502 may extend to a surface location. A wellbore 508 extends downward from the wellhead installation 504 through various subterranean formations 510. The wellbore 508 is depicted as being cased, but it could equally be an uncased wellbore 508.

The well system 500 may further include a subsurface safety valve 512 (hereafter "the safety valve 512") interconnected with a tubing 514 introduced into the wellbore 508 and extending from the wellhead installation 504. The tubing 514, which may comprise production tubing, may provide a fluid conduit for communicating fluids (e.g., hydrocarbons) extracted from the subterranean formations 510 to the well surface via the wellhead installation 504. A control line 516 and a balance line 518 may each extend to the wellhead installation 504, which, in turn, conveys the control and balance lines 516, 518 into an annulus 520 defined between the wellbore 508 and the tubing 514. The control and balance lines 516, 518 may originate from a control manifold or pressure control system (not shown) located at the well surface (i.e., a production platform), a control station, or a pressure control system located at the earth's surface or downhole. The control and balance lines 516, 518 extend from the wellhead installation 504 within the annulus 520 and eventually communicate with the subsurface safety valve 512.

As built into the tubing 514, the safety valve 512 may be referred to as a tubing retrievable safety valve (TRSV). The control line 516 may be used to actuate the safety valve 512 between open and closed positions. In some implementations, the control line 516 may be a hydraulic conduit that conveys hydraulic fluid to the safety valve 512. The hydraulic fluid may be applied under pressure to the control line 516 to open and maintain the safety valve 512 in its open position, thereby allowing production fluids to flow uphole through the safety valve 512, through the tubing 514, and to a surface location for production. To close the safety valve 512, the hydraulic pressure in the control line 516 may be reduced or eliminated. In the event the control line 516 is severed or rendered inoperable, or if there is an emergency at a surface location, the default position for the safety valve 512 may be the closed position to prevent fluids from advancing uphole past the safety valve 512 and otherwise preventing a blowout.

The balance line 518 may supply a balancing hydraulic force to compensate for the effects of hydrostatic pressure acting on the control line 516. More particularly, in order to enable the safety valve 512 to operate at increased depths, it is often necessary to balance the downhole hydrostatic forces assumed by the safety valve 512. The balance line 518 may supply hydraulic pressure to the safety valve 512 to provide a compensating force that overcomes such hydrostatic forces, thereby allowing the safety valve 512 to operate at increased wellbore depths.

Example Operations

Figure 6:
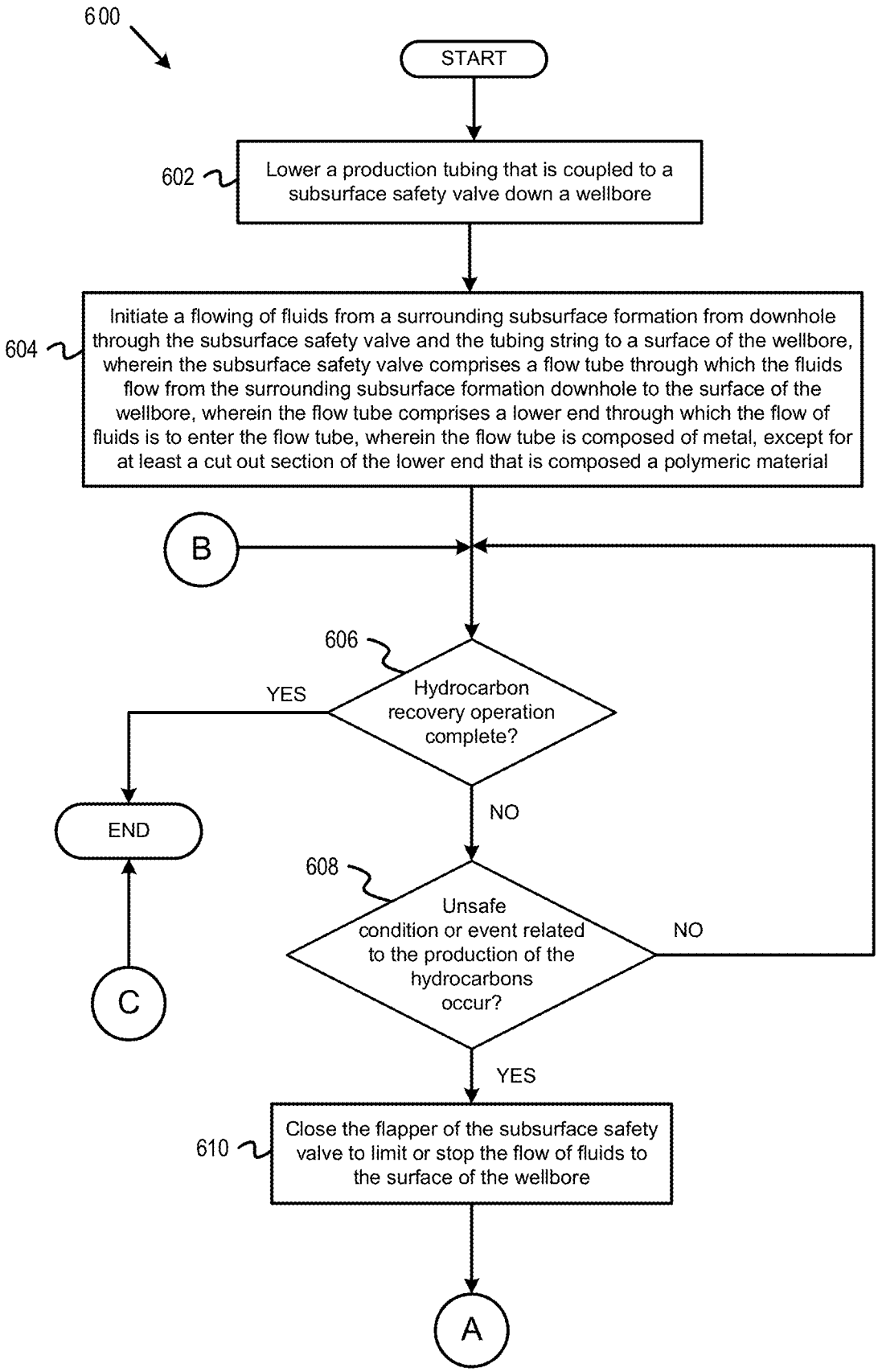
FIGS. 6-7 is a flowchart of example operations of using a subsurface safety valve, according to some embodiments.
Figure 7:
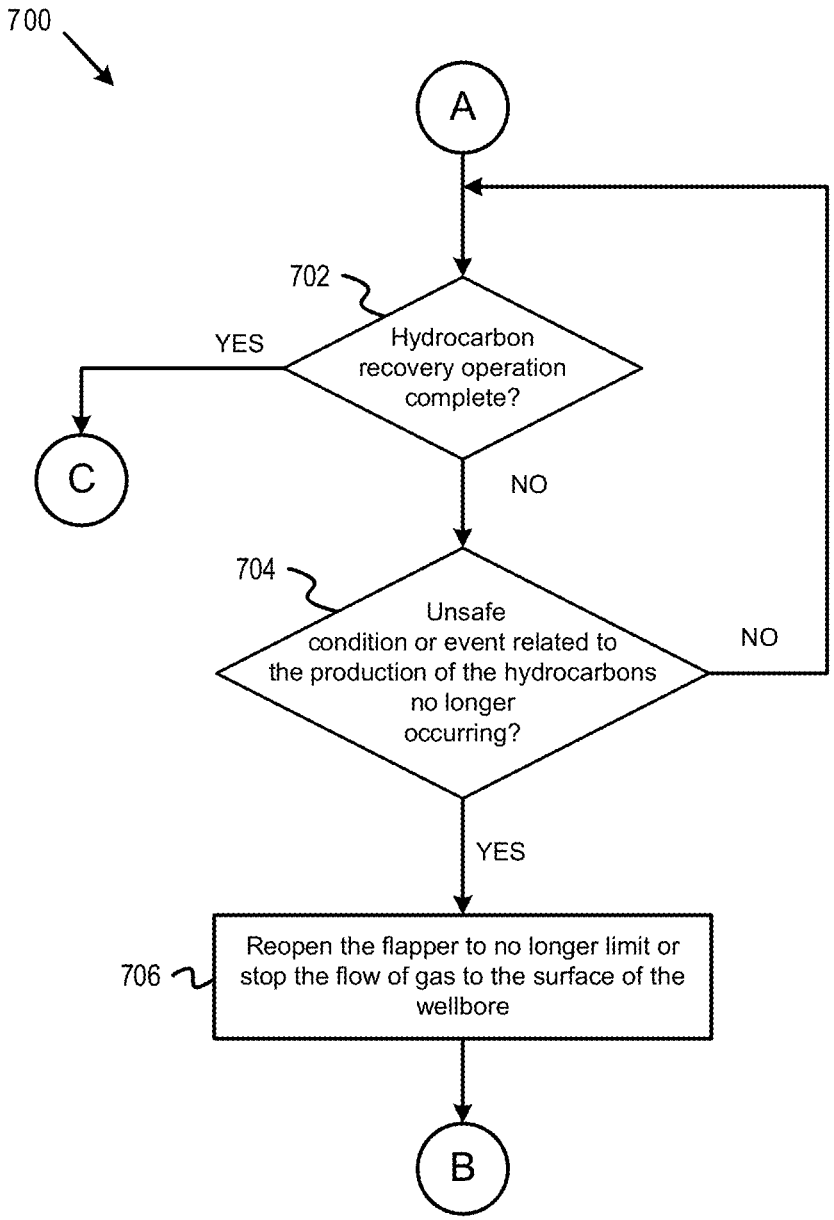

Example operations for using a subsurface safety valve are now described. In particular, FIGS. 6-7 is a flowchart of example operations of using a subsurface safety valve, according to some embodiments. Operations of a flowchart 600 and a flowchart 700 of FIGS. 6-7, respectively, can be performed by software, firmware, hardware, or a combination thereof. Operations of the flowcharts 600-700 continue between each other through transition points A-B. Operations of the flowcharts 600-700 are described in reference to FIGS. 1 and 5. However, other systems and components can be used to perform the operations now described. Operations of the flowchart 600 start at block 602.

At block 602, a production tubing having a subsurface safety valve may be lowered into the wellbore. For example, with reference to FIG. 5, the tubing 514 having the subsurface safety valve 512 may be lowered into the wellbore 508.

At block 604, a flowing of fluids from a surrounding subsurface formation from downhole through the subsurface safety valve and the tubing string to a surface of the wellbore is initiated, wherein the subsurface safety valve comprises a flow tube through which the fluids flow from the surrounding subsurface formation downhole to the surface of the wellbore, wherein the flow tube comprises a lower end through which the flow of fluids is to enter the flow tube, wherein the flow tube is composed of metal, except for at least a cut out section of the lower end that is composed a polymeric material. For example, with reference to FIG. 5, fluids from the subterranean formations 510 may below into the wellbore 508 and flow to the surface of the wellbore 508 through the subsurface safety valve 512 and up through the tubing 514.

At block 606, a determination is made of whether the hydrocarbon recovery operation is complete. For example, with reference to FIG. 5, a controller at a surface of the wellbore 508 may be coupled to the control line 516 to control the opening and closing of the subsurface safety valve 512. The controller may be operated to close the subsurface safety valve 512 when it is determined that the hydrocarbon recovery operations are complete (to stop the flow of hydrocarbons from the subterranean formations 510 to the surface of the wellbore 508). If the hydrocarbon recovery operation is complete, operations of the flowcharts 600-700 are complete. Otherwise, operations of the flowchart 600 continue at block 608.

At block 608, a determination is made of whether an unsafe condition or event related to the production of hydrocarbons occurred. For example, with reference to FIG. 5, the controller, operator, etc. may make this determination. For instance, it may be determined that a blowout, release of toxic gases, wellbore collapse, a kick, etc. has occurred in the wellbore 508. If an unsafe condition or event related to the production of hydrocarbons did not occur, operations of the flowchart 600 return to block 606 to again determine if the hydrocarbon recovery operation is complete. Otherwise, operations of the flowchart 600 continue at block 610.

At block 610, the flapper of the subsurface safety valve is closed to limit or stop the flow of fluids to the surface of the wellbore. For example, with reference to FIGS. 1 and 5, the controller at a surface of the wellbore 508 may close the flapper 106 via the control line 516. Operations of the flowchart 600 continue at transition point A, which continues at transition point A of the flowchart 700.

Operations of the flowchart 700 are now described. Operations of the flowchart 700 start at transition point A, which continues at block 702.

At block 702, a determination is made of whether the hydrocarbon recovery operation is complete. For example (as described above), with reference to FIG. 5, a controller at a surface of the wellbore 508 may be coupled to the control line 516 to control the opening and closing of the subsurface safety valve 512. The controller may be operated to close the subsurface safety valve 512 when it is determined that the hydrocarbon recovery operations are complete (to stop the flow of hydrocarbons from the subterranean formations 510 to the surface of the wellbore 508). If the hydrocarbon recovery operation is complete, operations of the flowcharts 600-700 are complete. Otherwise, operations of the flowchart 600 continue at block 704.

At block 704, a determination is made of whether the unsafe condition or event related to the production of hydrocarbons is no longer occurring. For example, with reference to FIG. 5, the controller, operator, etc. may make this determination. If an unsafe condition or event related to the production of hydrocarbons is still occurring, operations of the flowchart 700 return to block return to block 702 to again determine if the hydrocarbon recovery operation is complete. Otherwise, operations of the flowchart 700 continue at block 706.

At block 706, the flapper of the subsurface safety valve is reopened to no longer limit or stop the flow of fluids to the surface of the wellbore. For example, with reference to FIGS. 1 and 5, the controller at a surface of the wellbore 508 may reopen the flapper 106 via the control line 516. Operations of the flowchart 700 continue at transition point B, which continues at transition point B of the flowchart 600, which continues at transition point B. From transition point B of the flowchart 600, operations of the flowchart 600 continue at block 606 (where a determination is again made of whether the hydrocarbon operation is complete).

While the aspects of the disclosure are described with reference to various implementations and exploitations, it will be understood that these aspects are illustrative and that the scope of the claims is not limited to them. Many variations, modifications, additions, and improvements are possible. Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

The flowcharts are provided to aid in understanding the illustrations and are not to be used to limit scope of the claims. The flowcharts depict example operations that can vary within the scope of the claims. Additional operations may be performed; fewer operations may be performed; the operations may be performed in parallel; and the operations may be performed in a different order. It will be understood that each block of the flowchart illustrations and/or block diagrams, and combinations of blocks in the flowchart illustrations and/or block diagrams, can be implemented by program code. The program code may be provided to a processor of a general-purpose computer, special purpose computer, or other programmable machine or apparatus.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

As used herein, the term "or" is inclusive unless otherwise explicitly noted. Thus, the phrase "at least one of A, B, or C" is satisfied by any element from the set {A, B, C} or any combination thereof, including multiples of any element.

Example Embodiments

Embodiment #1: A safety valve for a wellbore for production of hydrocarbons from a surrounding subsurface formation, the safety valve comprising: a flow tube through which a flow of fluids from the surrounding subsurface formation downhole to a surface of the wellbore, wherein the flow tube comprises a lower end through which the flow of fluids is to enter the flow tube, wherein the flow tube is composed of metal, except for at least a cut out section of the lower end that is composed a polymeric material; and a flapper configured close the safety valve by changing positions to cover an opening at the lower end of the flow tube such that an impact force of the closing on the flapper onto the flow tube is at least partially absorbed by the polymeric material.

Embodiment #2: The safety valve of Embodiment #1, wherein the cut out section of the lower end is a portion of the lower end adjacent to the flapper while the flapper is in an open position.

Embodiment #3: The safety valve of any one of Embodiments #1-2, wherein the polymeric material comprises at least one of a rubber or plastic.

Embodiment #4: The safety valve of any one of Embodiments #1-3, wherein a shape of the cut out section comprises a rectangular shape.

Embodiment #5: The safety valve of Embodiment #4, wherein a width of the cut out section is greater than a depth of the cut out section.

Embodiment #6: The safety valve of any one of Embodiments #1-5, wherein a shape of the cut out section is an elliptical shape.

Embodiment #7: The safety valve of Embodiment #6, wherein a width of the cut out section is greater than a depth of the cut out section.

Embodiment #8: The safety valve of any one of Embodiments #1-7, wherein an end of the flow tube that is composed of metal is coated with a plastic material.

Embodiment #9: The safety valve of any one of Embodiments #1-8, wherein the fluids comprise at least one of a liquid or gas.

Embodiment #10: The safety valve of any one of Embodiments #1-9, wherein the width of the cut out section is less than one-half of the circumference of the flow tube.

Embodiment #11: The safety valve of any one of Embodiments #1-10, wherein the width of the cut out section is a subpart of the lower end of the flow tube.

Embodiment #12: A wellbore system comprising: a tubing string extendable within a wellbore; a subsurface safety valve interconnected with the tubing string, the subsurface safety valve comprising, a flow tube through which a flow of fluids from the surrounding subsurface formation downhole to a surface of the wellbore, wherein the flow tube comprises a lower end through which the flow of fluids is to enter the flow tube, wherein the flow tube is composed of metal, except for at least a cut out portion of the lower end that is composed a polymeric material; and a flapper configured close the subsurface safety valve by changing from an open position to a closed position to cover an opening at the lower end of the flow tube such that an impact force of the closing on the flapper onto the flow tube is at least partially absorbed by the polymeric material; and a valve tool to be positioned down the tubing string and to be engaged with the subsurface safety valve to move the flapper between the open position and the closed positions.

Embodiment #13: The wellbore system of Embodiment #12, wherein the cut out section of the lower end is a portion of the lower end adjacent to the flapper while the flapper is in an open position.

Embodiment #14: The wellbore system of any one of Embodiments #12-13, wherein the polymeric material comprises at least one of a rubber or plastic.

Embodiment #15: The wellbore system of any one of Embodiments #12-14, wherein a shape of the cut out section comprises at least one of a rectangular shape or an elliptical shape.

Embodiment #16: The wellbore system of Embodiment #15, wherein a width of the cut out section is greater than a depth of the cut out section.

Embodiment #17: The wellbore system of any one of Embodiments #12-16, wherein an end of the flow tube that is composed of metal is coated with a plastic material.

Embodiment #18: A method to shut down recovery of production of hydrocarbons from a wellbore, the method comprising: lowering a production tubing that is coupled to a subsurface safety valve down the wellbore; initiating a flowing of fluids from a surrounding subsurface formation from downhole through the subsurface safety valve and the production tubing to a surface of the wellbore, wherein the subsurface safety valve comprises, a flow tube through which the fluids flow from the surrounding subsurface formation downhole to the surface of the wellbore, wherein the flow tube comprises a lower end through which the flow of fluids is to enter the flow tube, wherein the flow tube is composed of metal, except for at least a cut out section of the lower end that is composed a polymeric material; and a flapper configured close the subsurface safety valve by changing positions to cover an opening at the lower end of the flow tube such that an impact force of the closing on the flapper onto the flow tube is at least partially absorbed by the polymeric material; determining whether an unsafe condition or event related to the production of the hydrocarbons has occurred; in response to determining that the unsafe condition or event related to the production of the hydrocarbons has occurred, closing the flapper, to limit or stop the flow of at least one of liquid or gas to the surface of the wellbore, to cover an opening at the lower end of the flow tube such that an impact force of the closing of the flapper onto the flow tube is at least partially absorbed by the polymeric material; and determining whether the unsafe condition or event is no longer occurring; and in response to determining that the unsafe condition or event is no longer occurring, reopening the flapper to no longer limit or stop the flow of the at least one of the liquid or the gas to the surface of the wellbore.

Embodiment #19: The method of Embodiment #18, wherein the cut out section of the lower end is a portion of the lower end adjacent to the flapper while the flapper is in an open position.

Embodiment #20: The method of any one of Embodiments #18-19, wherein the polymeric material comprises at least one of a rubber or plastic.

The invention claimed is:

1. A safety valve for a wellbore for production of hydrocarbons from a surrounding subsurface formation, the safety valve comprising:

a flow tube through which a flow of fluids passes from the surrounding subsurface formation downhole to a surface of the wellbore, wherein the flow tube comprises a lower end through which the flow of fluids is to enter the flow tube, wherein the flow tube is composed of metal, except for at least a cut out section of the lower end that is composed of a polymeric material; and a flapper configured to lose the safety valve by changing positions to cover an opening at the lower end of the flow tube such that an impact force of the closing of the flapper onto the flow tube is at least partially absorbed by the polymeric material.

2. The safety valve of claim 1, wherein the cut out section of the lower end is a portion of the lower end adjacent to the flapper while the flapper is in an open position.

3. The safety valve of claim 1, wherein the polymeric material comprises at least one of a rubber or plastic.

4. The safety valve of claim 1, wherein a shape of the cut out section comprises a rectangular shape.

5. The safety valve of claim 4, wherein a width of the cut out section is greater than a depth of the cut out section.

6. The safety valve of claim 1, wherein a shape of the cut out section is an elliptical shape.

7. The safety valve of claim 6, wherein a width of the cut out section is greater than a depth of the cut out section.

8. The safety valve of claim 1, wherein an end of the flow tube that is composed of metal is coated with a plastic material.

9. The safety valve of claim 1, wherein the fluids comprise at least one of a liquid or gas.

10. The safety valve of claim 1, wherein the width of the cut out section is less than one-half of the circumference of the flow tube.

11. The safety valve of claim 1, wherein the width of the cut out section is a subpart of the lower end of the flow tube.

12. A wellbore system comprising:

a tubing string extendable within a wellbore;

a subsurface safety valve interconnected with the tubing string, the subsurface safety valve comprising, a flow tube through which a flow of fluids passes from the surrounding subsurface formation downhole to a surface of the wellbore, wherein the flow tube comprises a lower end through which the flow of fluids is to enter the flow tube, wherein the flow tube is composed of metal, except for at least a cut out portion of the lower end that is composed of a polymeric material; and a flapper configured to close the subsurface safety valve by changing from an open position to a closed position to cover an opening at the lower end of the flow tube such that an impact force of the closing of the flapper onto the flow tube is at least partially absorbed by the polymeric material; and a valve tool to be positioned down the tubing string and to be engaged with the subsurface safety valve to move the flapper between the open position and the closed positions.

13. The wellbore system of claim 12, wherein the cut out section of the lower end is a portion of the lower end adjacent to the flapper while the flapper is in an open position.

14. The wellbore system of claim 12, wherein the polymeric material comprises at least one of a rubber or plastic.

15. The wellbore system of claim 12, wherein a shape of the cut out section comprises at least one of a rectangular shape or an elliptical shape.

16. The wellbore system of claim 15, wherein a width of the cut out section is greater than a depth of the cut out section.

17. The wellbore system of claim 12, wherein an end of the flow tube that is composed of metal is coated with a plastic material.

18. A method to shut down recovery of production of hydrocarbons from a wellbore, the method comprising:

lowering a production tubing that is coupled to a subsurface safety valve down the wellbore;

initiating a flowing of fluids from a surrounding subsurface formation from downhole through the subsurface safety valve and the production tubing to a surface of the wellbore, wherein the subsurface safety valve comprises, a flow tube through which the fluids passes flow from the surrounding subsurface formation downhole to the surface of the wellbore, wherein the flow tube comprises a lower end through which the flow of fluids is to enter the flow tube, wherein the flow tube is composed of metal, except for at least a cut out section of the lower end that is composed of a polymeric material; and a flapper configured to close the subsurface safety valve by changing positions to cover an opening at the lower end of the flow tube such that an impact force of the closing of the flapper onto the flow tube is at least partially absorbed by the polymeric material;

determining whether an unsafe condition or event related to the production of the hydrocarbons has occurred;

in response to determining that the unsafe condition or event related to the production of the hydrocarbons has occurred, closing the flapper, to limit or stop the flow of at least one of liquid or gas to the surface of the wellbore, to cover an opening at the lower end of the flow tube such that an impact force of the closing of the flapper onto the flow tube is at least partially absorbed by the polymeric material; and determining whether the unsafe condition or event is no longer occurring; and in response to determining that the unsafe condition or event is no longer occurring, reopening the flapper to no longer limit or stop the flow of the at least one of the liquid or the gas to the surface of the wellbore.

19. The method of claim 18, wherein the cut out section of the lower end is a portion of the lower end adjacent to the flapper while the flapper is in an open position.

20. The method of claim 18, wherein the polymeric material comprises at least one of a rubber or plastic.

* * * * *